US009256243B2

(12) United States Patent
Min

(10) Patent No.: US 9,256,243 B2
(45) Date of Patent: Feb. 9, 2016

(54) APPARATUS FOR REDUCING EFFORT OF CLUTCH PEDAL FOR VEHICLE

(71) Applicants: Hyundai Motor Company, Seoul (KR); Kia Motors Corporation, Seoul (KR)

(72) Inventor: Jeong Seon Min, Whasung-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 14/255,885

(22) Filed: Apr. 17, 2014

(65) Prior Publication Data

US 2015/0143943 A1 May 28, 2015

(30) Foreign Application Priority Data

Nov. 27, 2013 (KR) ..... 10-2013-0145527

(51) Int. Cl.
*G05G 5/03* (2008.04)
*G05G 1/44* (2008.04)

(52) U.S. Cl.
CPC ... *G05G 1/44* (2013.01); *G05G 5/03* (2013.01)

(58) Field of Classification Search
CPC ..... G05G 7/04; G05G 1/32
USPC ..... 74/512, 513, 560
See application file for complete search history.

(56) References Cited

U.S. PATENT DOCUMENTS

| | | | | |
|---|---|---|---|---|
| 1,572,815 | A | 2/1926 | Schultz | |
| 1,585,871 | A | 5/1926 | Pels | |
| 1,886,911 | A | 11/1932 | Schulman | |
| 3,251,520 | A | 5/1966 | Dyke et al. | |
| 5,445,300 | A | 8/1995 | Eipper et al. | |
| 5,555,774 | A | 9/1996 | Lauring et al. | |
| 6,142,036 | A * | 11/2000 | Mizuma et al. | 74/512 |
| 6,786,109 | B2 * | 9/2004 | Mueller et al. | 74/512 |
| 7,909,213 | B2 | 3/2011 | Bergerhoff et al. | |
| 7,926,383 | B2 * | 4/2011 | Choi et al. | 74/512 |
| 7,992,751 | B1 | 8/2011 | Sweeney | |
| 8,276,478 | B2 * | 10/2012 | Tokumo et al. | 74/512 |
| 2006/0162481 | A1 * | 7/2006 | Sato | 74/512 |
| 2007/0090142 | A1 | 4/2007 | Chuang | |
| 2007/0137398 | A1 * | 6/2007 | Tokumo et al. | 74/512 |
| 2010/0001029 | A1 | 1/2010 | Tai | |
| 2011/0030500 | A1 * | 2/2011 | Tokumo et al. | 74/512 |

FOREIGN PATENT DOCUMENTS

| | | | | |
|---|---|---|---|---|
| DE | 2543309 A | * | 7/1977 | G05G 7/04 |
| JP | 05-324110 A | | 12/1993 | |

(Continued)

*Primary Examiner* — Vicky Johnson
(74) *Attorney, Agent, or Firm* — Morgan, Lewis & Bockius LLP

(57) ABSTRACT

An apparatus for reducing an effort of a clutch pedal for a vehicle may include a pedal member through both sides of which a guide slot that may be extended frontwardly and then rearwardly may be formed integrally to pass the both sides, a pedal arm lever provided at an upper part of a pedal arm so as to be protruded towards the guide slot, a guide bar engaged to the pedal arm lever and passing through the guide slot, wherein the guide bar is movable along the guide slot when the pedal arm pivots, and an elastic member, a first end of which is connected to the pedal member, and a second end of which is connected to the guide bar, such that a turnover force is generated thereto when the pedal arm pivots forwardly and a recovery force is generated thereto when the pedal arm pivots rearwardly.

16 Claims, 8 Drawing Sheets

(56) References Cited

FOREIGN PATENT DOCUMENTS

| | | | |
|---|---|---|---|
| JP | 08-161069 | A | 6/1996 |
| JP | H08-161069 | A | 6/1996 |
| JP | 2605372 | Y2 | 5/2000 |
| JP | U2605372 | Y2 | 5/2000 |
| KR | 1999-0038653 | U | 10/1999 |
| KR | 10-2007-0016554 | A | 2/2007 |
| KR | 100820241 | B1 | 4/2008 |
| KR | 1020120118913 | A | 10/2012 |
| KR | 10-1500271 | B1 | 3/2015 |

* cited by examiner

APPARATUS FOR REDUCING EFFORT OF CLUTCH PEDAL FOR VEHICLE

CROSS-REFERENCE TO RELATED APPLICATION

The present application claims priority to Korean Patent Application No. 10-2013-0145527, filed on Nov. 27, 2013, the entire contents of which is incorporated herein for all purposes by this reference.

BACKGROUND

1. Field of the Invention

The present disclosure relates to an apparatus for reducing the effort of a clutch pedal for a vehicle, and more specifically, to an apparatus for reducing the effort of a clutch pedal for a vehicle, which can be used without damaging components even in a vehicle of a high horsepower provided with an engine of a high output while reducing the effort of a clutch pedal that is felt by a driver during an operation of the clutch pedal.

2. Description of Related Art

In a vehicle mounted with a manual transmission, the power of the engine may be transferred smoothly to the transmission only when no slippage occurs between the clutch disk and the flywheel while a clutch disk and a flywheel are coupled with each other capable of transferring power. On another hand, as a vehicle performance is improved, an engine of a high horsepower engine having a higher output has been used gradually, therefore spring force of a diaphragm has to be enhanced further for a tight coupling of the clutch disk and the flywheel, comparing to a conventional diaphragm, when using the engine of a high horsepower. For this purpose, a method for enlarging the diameter of a turnover spring has been proposed.

However, when spring force of the turnover spring is strengthened, the effort applied to the clutch pedal is increased, thus fatigue of a driver due to the manipulation of the pedal become relatively increased and especially, when the diameter of the turnover spring is enlarged, concentrated load that is applied to the turnover spring is increased. Accordingly, the components such as a spring bush for connecting the turnover spring and the pedal member may be damaged easily.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an apparatus for reducing the effort of a clutch pedal for a vehicle, through which the effort felt by a driver when operating the clutch pedal and can be used in a vehicle of a high horsepower provided with an engine of a high output without damaging the components.

In an aspect of the present invention, an apparatus for reducing an effort of a clutch pedal for a vehicle may include a pedal member through both sides of which a guide slot that is extended frontwardly and then rearwardly is formed integrally to pass the both sides, a pedal arm lever provided at an upper part of a pedal arm so as to be protruded towards the guide slot, a guide bar engaged to the pedal arm lever and passing through the guide slot, wherein the guide bar is movable along the guide slot when the pedal arm pivots, and an elastic member, a first end of which is connected to the pedal member, and a second end of which is connected to the guide bar, such that a turnover force is generated thereto when the pedal arm pivots forwardly and a recovery force is generated thereto when the pedal arm pivots rearwardly.

The apparatus for reducing the effort of the clutch pedal may further include a cowl bracket lever formed with a stopper groove, wherein a first end of the cowl bracket is connected to a cowl bracket that is combined with the pedal member, and wherein the guide bar is inserted at a second end the cowl bracket protruded towards the guide bar, wherein the guide bar fixes a position of the guide bar at ordinary times and rotates the pedal arm forcedly in a front direction when the cowl bracket rushes backwardly due to an accident.

The guide slot may include a lower guide slot extended from a lower front lower side to a front upper side of the pedal hinge along a rotary radius of the pedal hinge, a curved part curved from the front upper side to a rear lower side of the lower guide slot, and an upper guide slot extended from the rear lower side of the curved part to a rear upper side.

A movement trajectory of the guide bar that is formed by moving along the guide slot is shorter than a rotation trajectory of the pedal arm lever in order to generate turnover force more easily.

A lever hole opened toward a tip end is formed at the pedal arm lever and the guide bar is fitted into the lever hole.

The elastic member is a tensile spring, a first end of which is fixed to an upper part of the pedal member, and a second end of which is fixed to the guide bar while the tensile spring is disposed at a rear upper side of the guide slot.

The elastic member is a compression spring, a first end of which is fixed to a front of the pedal member and a second end of which is fixed to the guide bar while the compression spring is disposed at a front of the guide slot.

A bush is connected to a bottom of the cowl bracket lever so as to prevent noise, wherein a stopper groove is formed in the bush.

The stopper groove may include a lower stopper groove into which the guide bar is inserted when the guide bar is disposed at the lower guide slot, and an upper stopper groove into which the guide bar is inserted when the guide bar is disposed at the upper guide slot.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
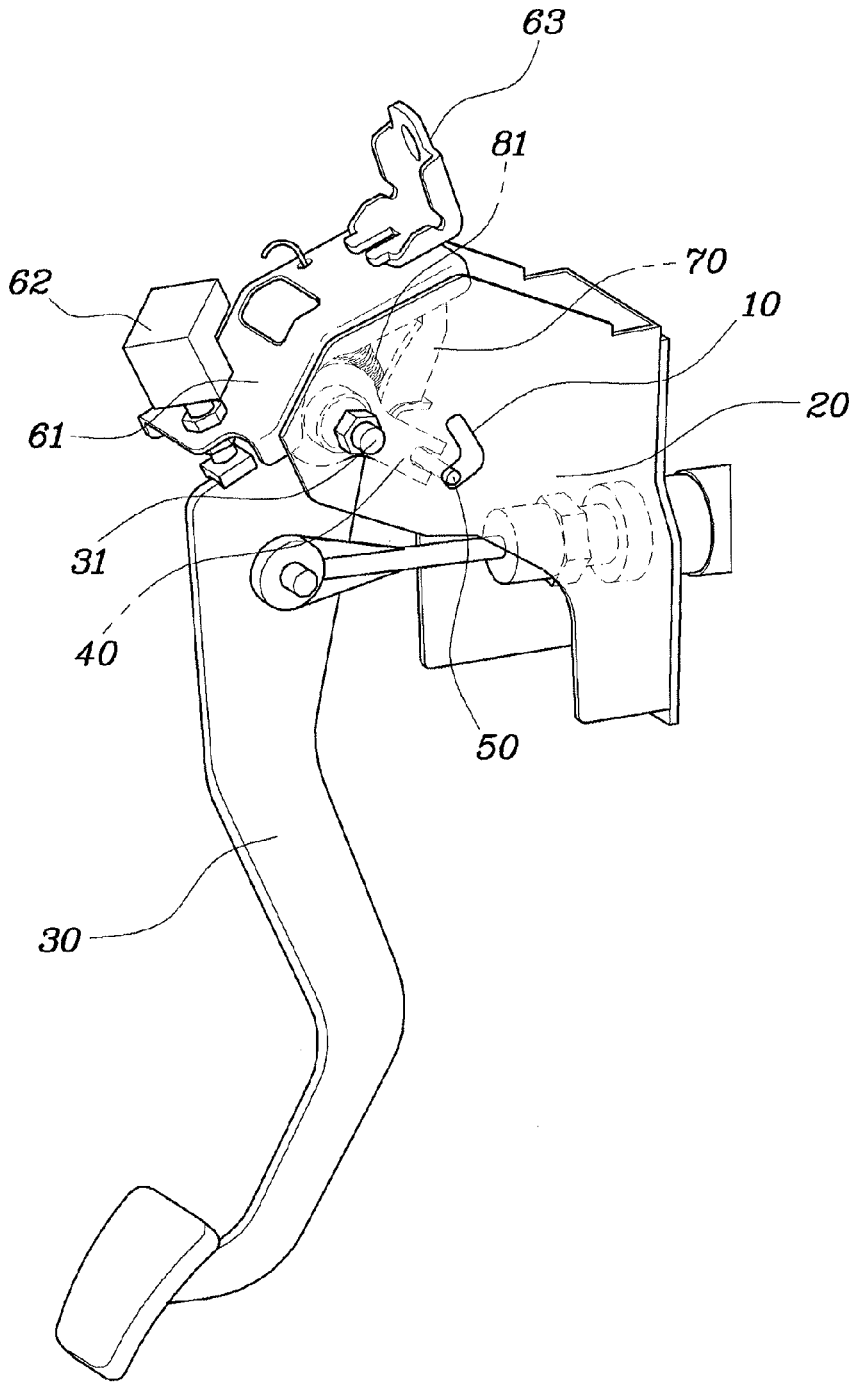
FIG. 1 and FIG. 2 are a perspective view and a side view showing a clutch pedal equipped with an apparatus for reducing the effort of the clutch pedal according to an exemplary embodiment of the present invention, respectively.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an apparatus for reducing the effort of a clutch pedal according to an exemplary embodiment of the present invention will be explained in detail referring to the accompanying drawings.

As shown in FIGS. 1 to 7, an apparatus for reducing the effort of a clutch pedal according to an exemplary embodiment of the present invention includes: a pedal member 20 which is fixed to a vehicle body panel (dash panel) at the lower front part of a driver's seat and through both sides of which a guide slot 10 that is extended frontwardly and then rearwardly is formed integrally to pass, a pedal arm lever 40 provided at the upper part of a pedal arm 30 so as to protrude toward the guide slot 10, a guide bar 50 installed movably along the guide slot 10 when the pedal arm 30 pivots while passing through integrally the guide slot 10 and the pedal arm lever 40, and an elastic member one end of which is connected to the pedal member 20 and another end of which is connected to the guide bar 50 such that turnover force is generated when the pedal arm 30 pivots forwardly and recovery force is generated when the pedal arm 30 pivots rearwardly.

Here, the pedal member 20 is a "C" shaped bracket whose upper side, lower side and backside are opened wherein the pedal member is arranged such that a portion connecting both sides is directed forwardly.

The pedal arm 30 is disposed in the inner space of the pedal member 20 wherein an upper part of the pedal arm 30 is pivotable forwardly/rearwardly with respect to the pedal member 20 through a pedal hinge 31.

A switch bracket 61 is combined with the upper part of the pedal member 20, a pedal switch 62 is connected to the rear side of the switch bracket 61 and a cowl bracket 63 is connected to the front side of the switch bracket 61.

Additionally, an apparatus for reducing the effort of a clutch pedal according to an exemplary embodiment of the present invention further includes a cowl bracket lever 70 one end of which is connected to the cowl bracket 63 combined with the pedal member 20 and on another end of which, which protrudes toward the guide bar 50, a stopper groove 91 into which the guide bar 50 is inserted is provided. In ordinary times when an accident does not occur, the cowl bracket lever 70 plays a role of fixing the position of the guide bar 50, and when the cowl bracket 63 rushes in a rear direction due to an accident, it serves to prevent injury of the lower limb (an ankle, the shin, etc.) due to the pedal arm 30 by rotating the pedal arm 30 forcedly in a front direction. The guide slot 10 formed at the pedal member 20 includes: a lower guide slot 11 extended from a front lower side to a front upper side of the pedal hinge 31 along the rotary radius of the pedal hinge 31, a curved part 12 curved from the top end to rear upper side of the lower guide slot 11, and an upper guide slot 13 extended from the curved part 12 to the rear upper side.

The section of the lower guide slot 11 refers to a place where the pedal arm 30 is recovered fully by receiving the elastic force of a tension spring 81 or a compression spring 82, which will be described later, when the pedal arm 30 is returned backwardly, and the curved part 12 is a section where maximum effort is felt when the guide bar 50 is disposed in this section, and the upper guide slot 13 is a section where turnover force is generated in the pedal arm 30 by receiving the elastic force of the tension spring 81 or the compression spring 82 when the pedal arm 30 rotates forwardly.

Here, the movement trajectory of the guide bar 50 which is formed by moving along the guide slot 10 is characterized by being shorter than the rotation trajectory of the pedal arm lever 40 in order to generate a turnover force more easily in the pedal arm 30 when the guide bar 50 passes the curved part 12 and then moves to the upper guide slot 13, thereby increasing the magnitude of the turnover force generated in the pedal arm 30. A lever hole 41 opened toward a tip end is formed at the pedal arm lever 40 wherein the guide bar 50 is fitted into the lever hole 41.

Meanwhile, the elastic member may be a tensile spring 81 one end of which is fixed to the upper part of the pedal member 20 and another end of which is fixed to the guide bar 50 while it is disposed at the rear upper side of the guide slot 10, however as an another embodiment, the elastic member may be a compression spring 82 one end of which is fixed to the front side of the pedal member 20 and another end of which is fixed to the guide bar 50 while it is disposed at the front side of the guide slot 10.

A bush 90 is connected to the bottom of the cowl bracket lever 70 in order to prevent noise, wherein a stopper groove 91 is formed.

The bush 90 may be preferably made of rubber or silicone for preventing noise and reducing shock, but it is not limited thereto.

The stopper groove 91 includes a lower stopper groove 91 a into which the guide bar 50 is inserted when the guide bar 50 is disposed at the lower guide slot 11 and an upper stopper groove 91*b* into which the guide bar 50 is inserted when the guide bar 50 is disposed at the upper guide slot 13 wherein the lower stopper groove 91*a* and the upper stopper groove 91*b* are connected consecutively.

Hereinafter, the operation of an exemplary embodiment of the present invention will be described.

Figure 2:
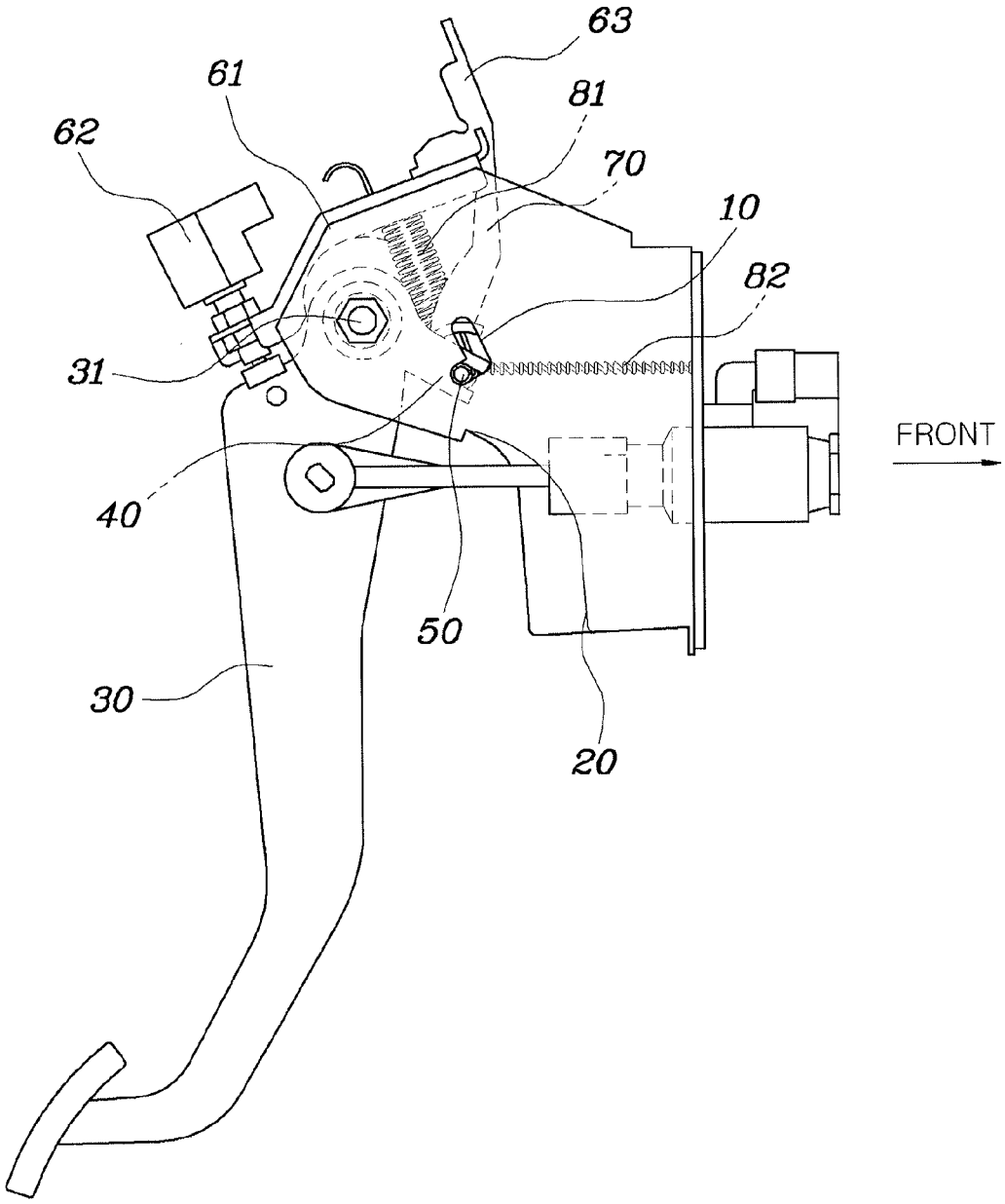
Figure 3:
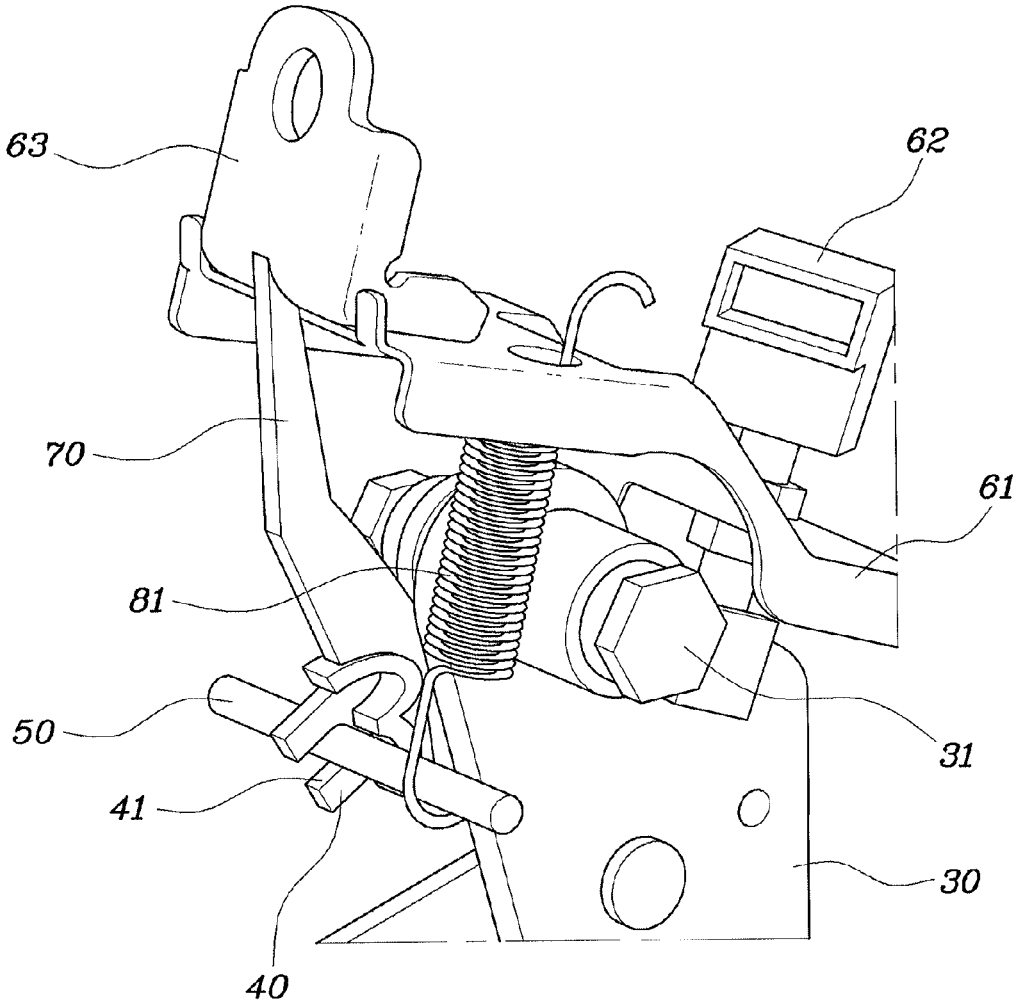
FIG. 3 is a perspective view showing a clutch pedal as shown in FIG. 1 with a pedal member removed.
Figure 4:
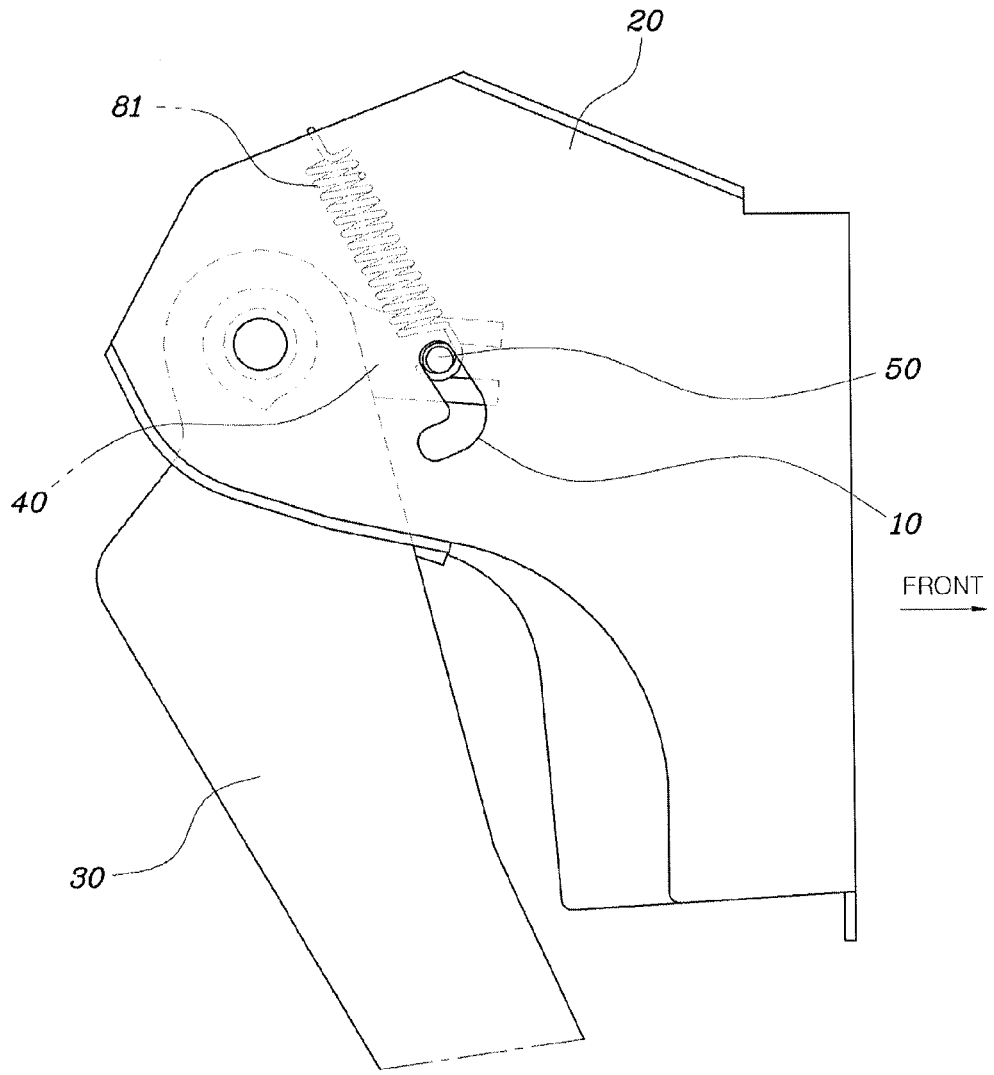
FIG. 4 is a view showing a state where turnover force is generated by rotating a pedal arm forwardly.
Figure 5:
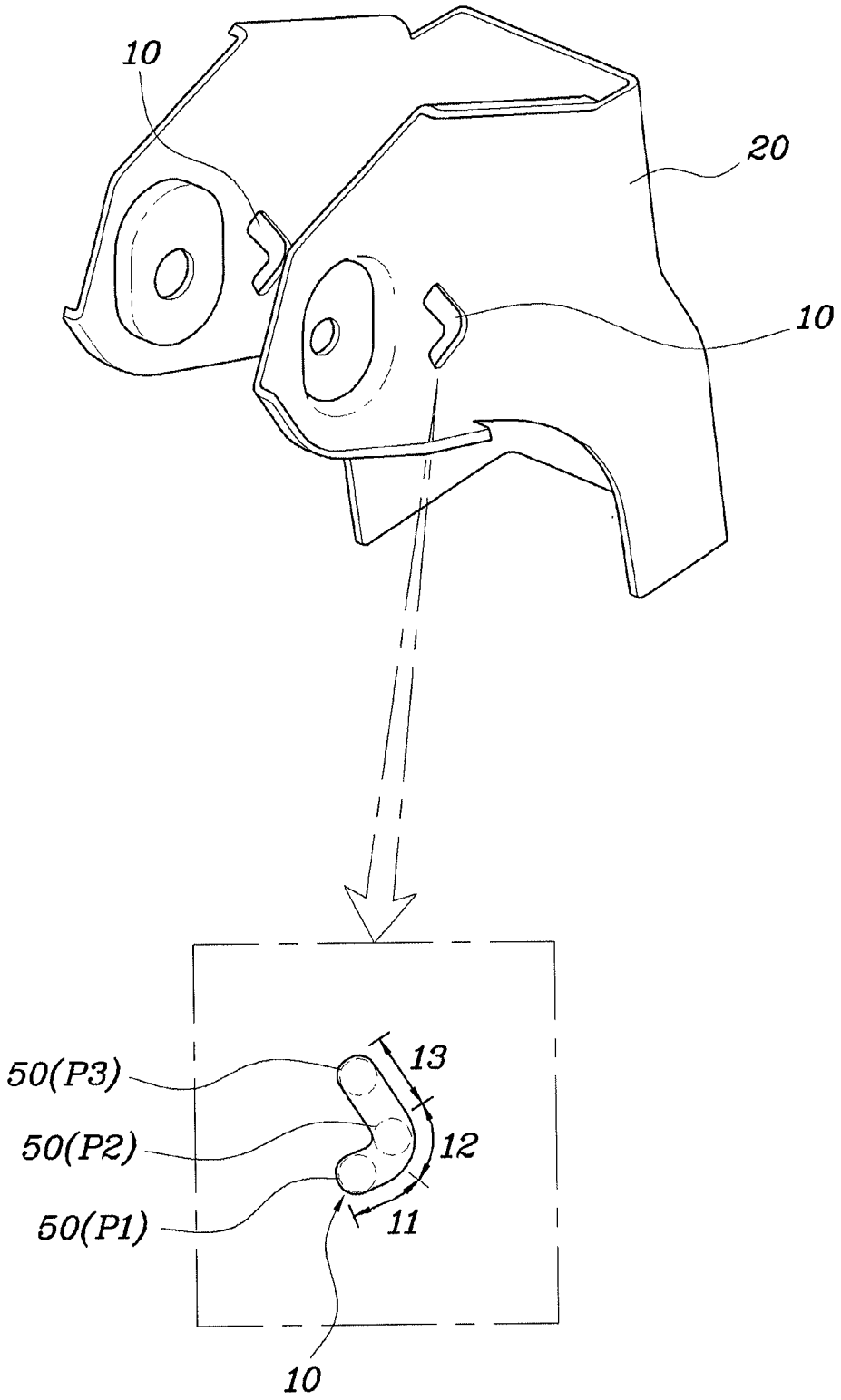
FIGS. 5 to 7 are perspective views showing a pedal member, a pedal arm lever and a cowl bracket lever according to an exemplary embodiment of the present invention, respectively.
Figure 6:
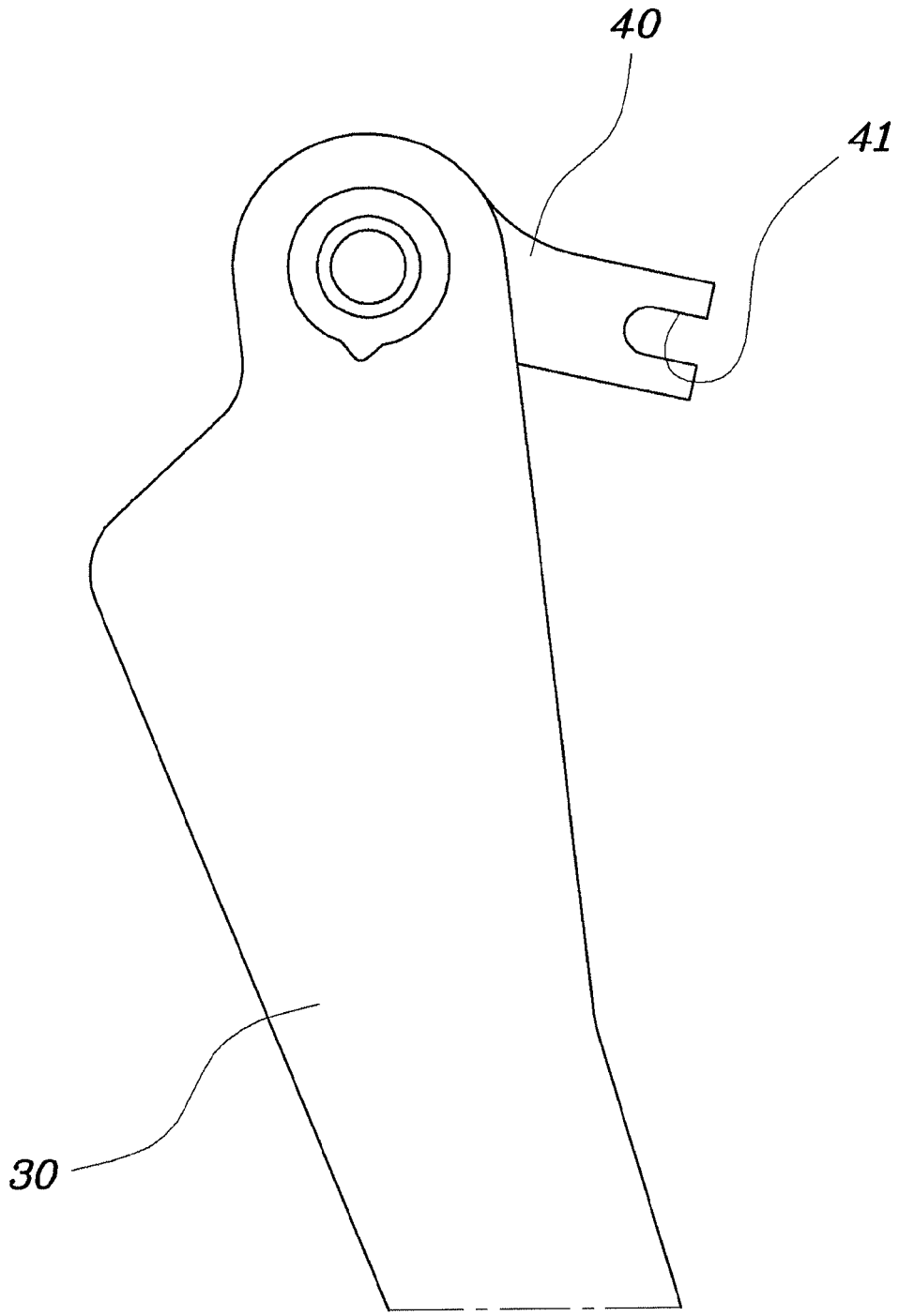
Figure 7:
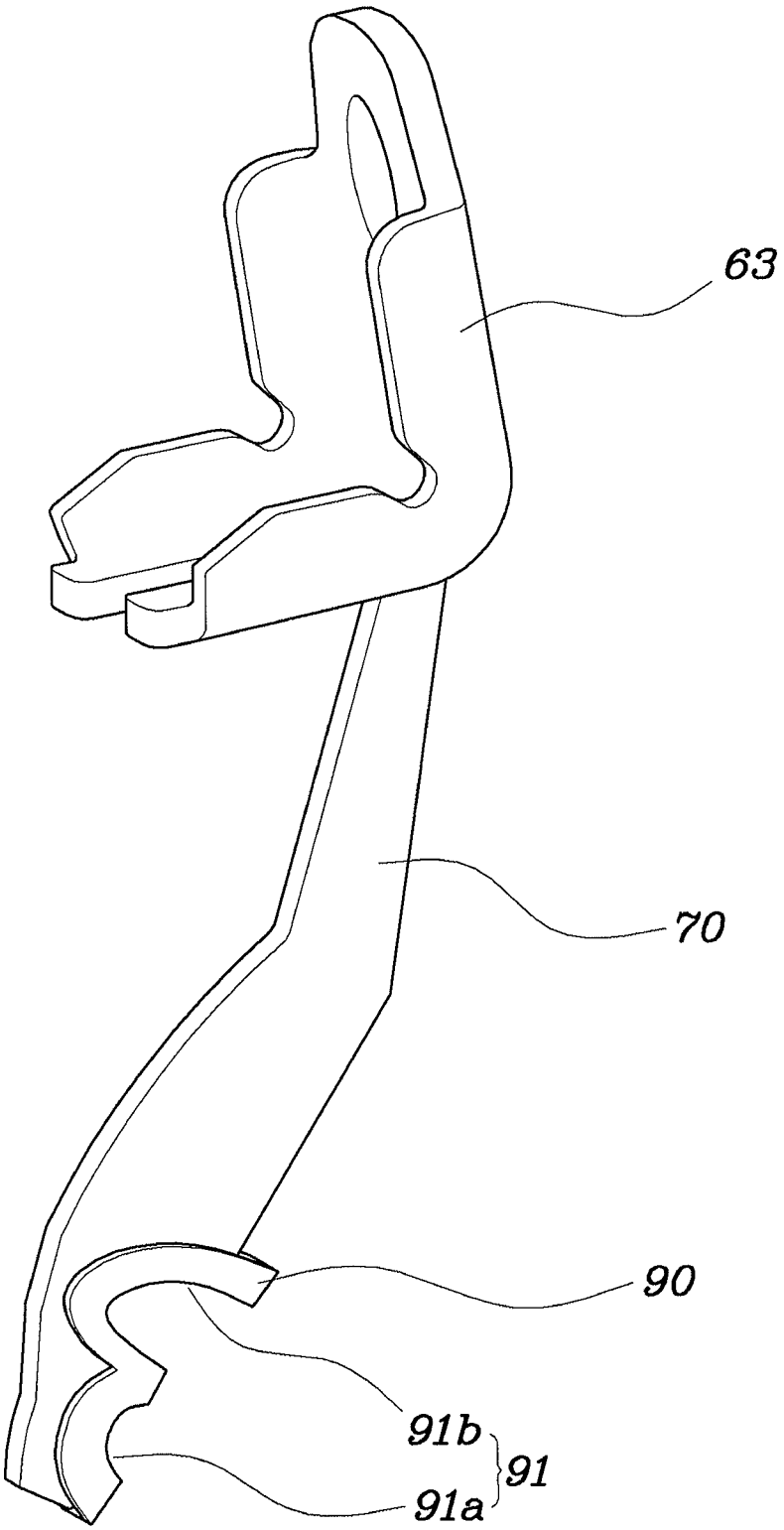

FIGS. 1 to 2 show a status before stepping down on the pedal arm 30 by a driver, and at this time the guide bar 50 is disposed at the lower guide slot 11 as shown in P1 status of FIG. 5.

Under above condition, the pedal arm 30 is pivoted forwardly around the pedal hinge 31 when the driver steps down on the pedal arm 30 for operation, and the guide bar 50 is moved toward the curved part 12, and the tension spring 81 is compressed to be lengthened gradually.

In the process of the movement of the guide bar 50 towards the curved part 12, the repulsive force of a tension spring 81 is transmitted to the pedal arm 30 through the guide bar 50, and as a result a reaction force is generated in the opposite direction to which the driver's load is applied on the pedal arm 30, accordingly the effort felt by the driver is increased gradually, and at this time, the driver comes to sense the reaction force transmitted from the pedal arm 30, and then senses the operating condition of the pedal arm 30.

Further, the moment when the guide bar 50 reaches to the curved part 12 (P2 status in FIG. 5) while the pedal arm 30 pivots forwardly continuously becomes a status where the length of the tension spring 81 is extended to the maximum, and as a result the repulsive force becomes a maximum value, and at this time the effort felt by the driver becomes maximum.

Additionally, when the guide bar 50 passes through the curved part 12 and then enters into the upper guide slot 13 while the pedal arm 30 pivots forwardly continuously, the tension spring 81 which has been lengthened returns to its original length to pull the guide bar 50 upwardly, and at this moment the pedal arm 30 is moved forwardly by the pulling force of the tensile spring 81. At this time, the repulsive force of the tensile spring 81, which is applied to the pedal arm 30, is reduced abruptly and at the same time the effort felt by the driver is also reduced, and as a result the driver will feel less fatigue when operating the pedal arm 30 due to the reduced effort.

Additionally, according to an exemplary embodiment of the present invention, even in the backward returning process of the pedal arm 30 which has been pivoted forwardly, the tension spring 81 pulls the guide bar 50 into the lower guide slot 11 thereby inducing a complete return of the pedal arm 30, which enables a clutch disk and a flywheel to be coupled more tightly. Accordingly, the apparatus can be used without damaging the components even in a vehicle of a high horsepower provided with an engine of a high output.

Further, according to an exemplary embodiment of the present invention the pedal arm 30 is pivoted forcibly forwardly by the cowl bracket lever 70 at a head-on collision or a rear-end collision of a vehicle, thereby maximally preventing the injury of the lower limb (an ankle, the shin, etc.) due to the pedal arm 30.

Figure 8:
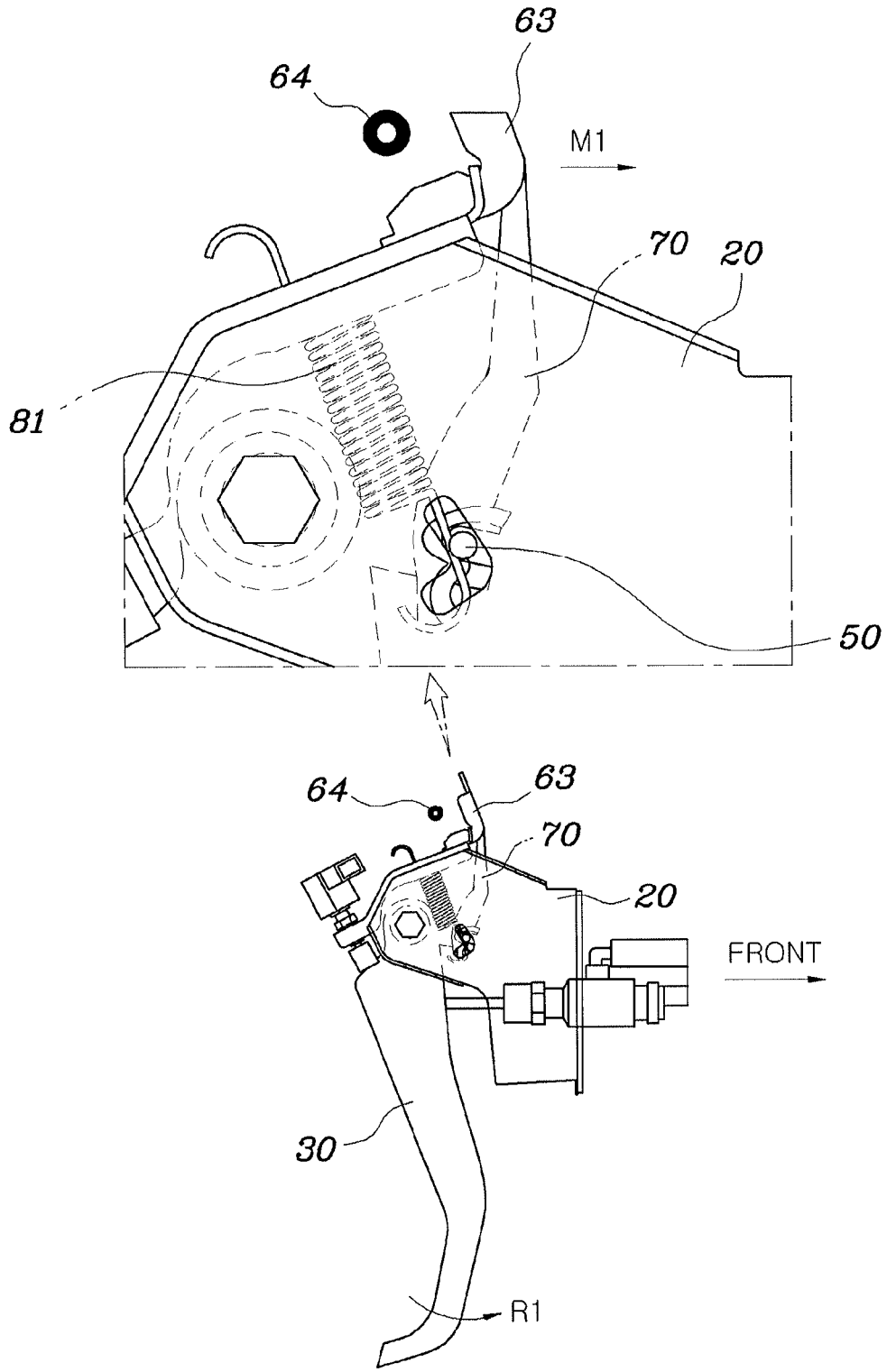
FIG. 8 is a view describing a status where a pedal arm is reverse-pivoted forwardly by a cowl bracket lever according to an exemplary embodiment of the present invention at the time of an accident.

That is, when a head-on collision or a rear-end collision of a vehicle occurs and the pedal member 20 rushes backwardly together with a dash panel , a cowl bracket 63 becomes in contact with a cowl crossbar 64 to be pushed forwardly (refer to the arrow M1) as shown in FIG. 8, and at this time the cowl bracket lever 70 allows the guide bar 50 that is disposed at the position of the lower guide slot 11 to be moved to the position of the upper guide slot 13 and then by the movement of the guide bar 50, the pedal arm lever 40 and the pedal arm 30 are pivoted as illustrated with an arrow R1 (counter -clockwise) around the pedal hinge 31, and in this process, the lower part of the pedal arm 30 stepped down by the driver is pivoted forcedly in the front direction and recedes in the distance from the driver.

Accordingly, as the lower part of the pedal arm 30 is pivoted forcedly in the front direction at an accident, driver's injury such as hitting his shin against a pedal or being bent backwardly can be prevented, thereby maximally preventing the occurrence of driver's injury of lower limb due to the pedal arm 30.

As described above, according to an exemplary embodiment of the present invention, the effort is provided to the pedal arm 30 by the tensile spring 81 until the guide bar 50 reaches to the curved part 12 from the lower guide slot 11 when the pedal arm 30 pivots forwardly, and the guide bar 50 is pulled upwardly by a great spring force and thus the pedal arm 30 is moved forwardly by a spring force while the guide bar 50 passes through the curved part 12 and then enters into the upper guide slot 13, thereby reducing the effort transmitted to the pedal arm 30 greatly and substantially alleviating fatigue of the driver according to the operation of the pedal arm 30.

Additionally, according to an exemplary embodiment of the present invention, the tension spring 81 pulls the guide bar 50 towards the lower guide slot 11 even at a backward returning of the pedal arm 30 that has been pivoted forwardly, thereby inducing the complete returning of the pedal arm 30 and thus trying to couple a clutch disc and a flywheel tightly. As a result, the apparatus can be used without damaging the components in a vehicle of a high horsepower provided with an engine of a high output Additionally, according to an exemplary embodiment of the present invention, the pedal arm 30 is pivoted forcibly forwardly by the cowl bracket 70 at a head-on collision or a rear-end collision of a vehicle, thereby preventing maximally the occurrence of injury of the lower limb (an ankle, the shin, etc.) due to the pedal arm 30.

According to an exemplary embodiment of the present invention, a driver's effort can be reduced greatly by a spring force when a pedal arm pivots forwardly according to the operation of the driver, thereby substantially reducing fatigue of the driver due to the manipulation of the pedal and inducing the complete returning of the pedal arm when the pedal arm returns backwardly that has been pivoted forwardly to try a tight coupling of a clutch disk and a flywheel. Accordingly, the apparatus can be used without damaging the components in a vehicle of a high horsepower provided with an engine of a high output.

Additionally, according to an exemplary embodiment of the present invention, the pedal arm is pivoted forcibly by the cowl bracket lever at a head-on collision or a rear-end collision of a vehicle, thereby preventing the occurrence of injury of the lower limb due to the pedal arm.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for reducing an effort of a clutch pedal for a vehicle comprising:

a pedal member through both sides of which a guide slot that is extended frontwardly and then rearwardly is formed integrally to pass the both sides;

a pedal arm lever provided at an upper part of a pedal arm so as to be protruded towards the guide slot;

a guide bar engaged to the pedal arm lever and passing through the guide slot, wherein the guide bar is movable along the guide slot when the pedal arm pivots around a pedal hinge; and an elastic member, a first end of which is connected to the pedal member, and a second end of which is connected to the guide bar, such that a turnover force is generated thereto when the pedal arm pivots forwardly and a recovery force is generated thereto when the pedal arm pivots rearwardly, wherein the guide slot includes:

a lower guide slot extended from a front lower side of the pedal hinge in a front upper direction along a rotary radius of the pedal hinge;

a curved part curved from a top end of the lower guide slot in a rear upper direction; and an upper guide slot extended from the curved part in the rear upper direction.

2. The apparatus for reducing the effort of the clutch pedal for the vehicle of claim 1, further comprising:

a cowl bracket lever formed with a stopper groove, wherein a first end of the cowl bracket lever is connected to a cowl bracket that is combined with the pedal member, and wherein the guide bar is inserted at a second end of the cowl bracket lever protruded towards the guide bar, wherein the guide bar fixes a position of the guide bar at ordinary times and rotates the pedal arm forcedly in a front direction when the cowl bracket rushes backwardly due to an accident.

3. The apparatus for reducing the effort of the clutch pedal for the vehicle of claim 1, wherein a movement trajectory of the guide bar that is formed by moving along the guide slot is shorter than a rotation trajectory of the pedal arm lever in order to generate turnover force more easily.

4. The apparatus for reducing the effort of the clutch pedal for the vehicle of claim 1, wherein a lever hole opened toward a tip end is formed at the pedal arm lever and the guide bar is fitted into the lever hole.

5. The apparatus for reducing the effort of the clutch pedal for the vehicle of claim 1, wherein the elastic member is a tensile spring, a first end of which is fixed to an upper part of the pedal member, and a second end of which is fixed to the guide bar while the tensile spring is disposed at a rear upper side of the guide slot.

6. The apparatus for reducing the effort of the clutch pedal for the vehicle of claim 1, wherein the elastic member is a compression spring, a first end of which is fixed to a front of the pedal member and a second end of which is fixed to the guide bar while the compression spring is disposed at a front of the guide slot.

7. The apparatus for reducing the effort of the clutch pedal for the vehicle of claim 1, wherein a bush is connected to a bottom of the cowl bracket lever so as to prevent noise;

and wherein a stopper groove is formed in the bush.

8. The apparatus for reducing the effort of the clutch pedal for the vehicle of claim 7, wherein the stopper groove includes:

a lower stopper groove into which the guide bar is inserted when the guide bar is disposed at the lower guide slot; and an upper stopper groove into which the guide bar is inserted when the guide bar is disposed at the upper guide slot.

9. An apparatus for reducing an effort of a clutch pedal for a vehicle comprising:

a pedal member through both sides of which a guide slot that is extended frontwardly and then rearwardly is formed integrally to pass the both sides;

a pedal arm lever provided at an upper part of a pedal arm so as to be protruded towards the guide slot;

a guide bar engaged to the pedal arm lever and passing through the guide slot, wherein the guide bar is movable along the guide slot when the pedal arm pivots around a pedal hinge; and an elastic member, a first end of which is connected to the pedal member, and a second end of which is connected to the guide bar, such that a turnover force is generated thereto when the pedal arm pivots forwardly and a recovery force is generated thereto when the pedal arm pivots rearwardly, wherein the elastic member is a tensile spring, a first end of which is fixed to an upper part of the pedal member, and a second end of which is fixed to the guide bar while the tensile spring is disposed at a rear upper side of the guide slot.

10. The apparatus for reducing the effort of the clutch pedal for the vehicle of claim 9, further comprising:

a cowl bracket lever formed with a stopper groove, wherein a first end of the cowl bracket lever is connected to a cowl bracket that is combined with the pedal member, and wherein the guide bar is inserted at a second end of the cowl bracket lever protruded towards the guide bar; and wherein the guide bar fixes a position of the guide bar at ordinary times and rotates the pedal arm forcedly in a front direction when the cowl bracket rushes backwardly due to an accident.

11. The apparatus for reducing the effort of the clutch pedal for the vehicle of claim 9, wherein the guide slot includes:

a lower guide slot extended from a front lower side of the pedal hinge in a front upper direction along a rotary radius of the pedal hinge;

a curved part curved from a top end of the lower guide slot in a rear upper direction; and an upper guide slot extended from the curved part in the rear upper direction.

12. The apparatus for reducing the effort of the clutch pedal for the vehicle of claim 11, wherein a bush is connected to a bottom of the cowl bracket lever so as to prevent noise;

and wherein a stopper groove is formed in the bush.

13. The apparatus for reducing the effort of the clutch pedal for the vehicle of claim 12, wherein the stopper groove includes:

a lower stopper groove into which the guide bar is inserted when the guide bar is disposed at the lower guide slot; and an upper stopper groove into which the guide bar is inserted when the guide bar is disposed at the upper guide slot.

14. The apparatus for reducing the effort of the clutch pedal for the vehicle of claim 9, wherein a movement trajectory of the guide bar that is formed by moving along the guide slot is shorter than a rotation trajectory of the pedal arm lever in order to generate turnover force more easily.

15. The apparatus for reducing the effort of the clutch pedal for the vehicle of claim 9, wherein a lever hole opened toward a tip end is formed at the pedal arm lever and the guide bar is fitted into the lever hole.

16. The apparatus for reducing the effort of the clutch pedal for the vehicle of claim 9, wherein the elastic member is a compression spring, a first end of which is fixed to a front of the pedal member and a second end of which is fixed to the guide bar while the compression spring is disposed at a front of the guide slot.

* * * * *